United States Patent [19]

Gillum

[11] 4,453,656

[45] Jun. 12, 1984

[54] FLYING DISC CARRYING CLIP

[76] Inventor: Joseph A. Gillum, 2341 N. 20th St., Milwaukee, Wis. 53208

[21] Appl. No.: 330,185

[22] Filed: Dec. 14, 1981

[51] Int. Cl.[3] ..... A44B 21/00

[52] U.S. Cl. ..... 224/247; 224/252; 224/269

[58] Field of Search ..... 224/269, 268, 252, 247; 24/3 J, 3 L, 255 BS; 46/32, 74 D; 220/85 H; D8/371

[56] References Cited

U.S. PATENT DOCUMENTS

| | | | |
|---|---|---|---|
| 1,911,256 | 5/1933 | Andrew | 224/252 X |
| 2,138,978 | 12/1938 | Meine | 224/252 |
| 2,589,126 | 3/1952 | Payne | 224/5 |
| 2,661,129 | 12/1953 | Seaton et al. | 224/252 X |
| 3,146,925 | 9/1964 | Ruderian | 224/268 |
| 3,873,009 | 3/1975 | Goudreau | 224/5 D |
| 3,983,602 | 10/1976 | Barry | 24/11 R |
| 4,062,482 | 12/1977 | Szalony | 224/5 D |
| 4,248,435 | 2/1981 | Barmore | 273/331 |
| 4,277,863 | 7/1981 | Faneuf | 224/247 X |

*Primary Examiner*—Steven M. Pollard

[57] ABSTRACT

Disclosed herein is an apparatus for holding a flying disc having a curved outer edge portion. The apparatus preferably comprises an integrally molded clip including a generally U-shaped portion for securing the clip to a wearer's garment, and including spaced apart curved arms connected to the U-shaped portion and which generally conform to the curved outer edge portion of the flying disc so that the outer edge portion can be inserted and removably held between the arms. In a preferred embodiment, one of the curved arms is movably connected to the U-shaped portion and biased toward the other curved arm to allow for receiving and releasing the outer edge portion of the flying disc.

6 Claims, 5 Drawing Figures

FLYING DISC CARRYING CLIP

BACKGROUND OF THE INVENTION

The invention relates generally to devices for holding athletic equipment, and, more particularly, to devices which can be worn on wearing apparel and used for holding athletic equipment. Attention is directed to the following U.S. Patents:

| Patentee | U.S. Pat. No. |
|---|---|
| Szalony | 4,062,482 |
| Barry | 3,983,602 |
| Seaton | 2,661,129 |
| Barmore | 4,248,435 |
| Andrew | 1,911,256 |
| Payne | 2,589,126 |
| Goudreau | 3,873,009 |

SUMMARY OF THE INVENTION

The invention provides an apparatus for holding a flying disc on an article of clothing, thereby permitting the wearer of the apparatus to have free use of both hands. The apparatus preferably comprises a clip including first means for securing the clip to a wearer's garment, and second means for securing the curved outer edge portion of a flying disc to the clip. The clip first means preferably comprises a generally U-shaped portion for fitting over the wearer's belt or pants top, and the second means preferably comprises a pair of curved spaced-apart arms which generally conform to the curved outer edge of the flying disc. The curved arms are flexible and resilient to permit the insertion of the disc between the arms so that the curved outer edge portion is retained therein.

In one embodiment of the invention, a generally U-shaped resilient material is secured between the pair of arms for receiving, holding and releasing the curved edge of the flying disc.

In another embodiment of the invention, one of the arms is movably connected to the U-shaped portion of the clip and the second means also includes bias means for biasing the movable arm toward the other arm. The movable arm may be pulled away from the other arm for allowing either insertion or removal of the flying disc from between the arms of the clip.

Other features, objects and advantages of the invention will become apparent from the following description, the claims and accompanying drawing.

DESCRIPTION OF THE PREFERRED EMBODIMENTS

Figure 1:
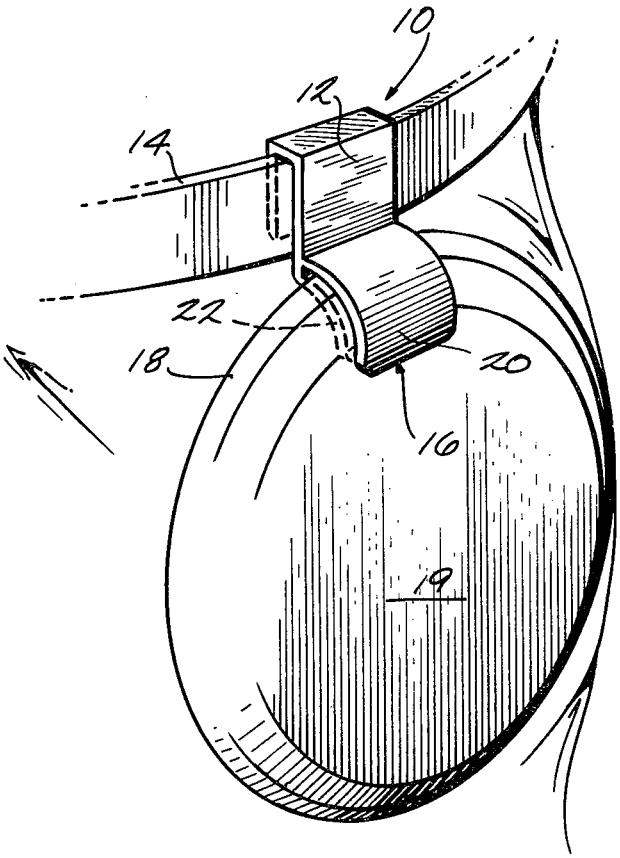
FIG. 1 is a perspective view of an apparatus holding a flying disc and which embodies various features of the invention.
Figure 2:
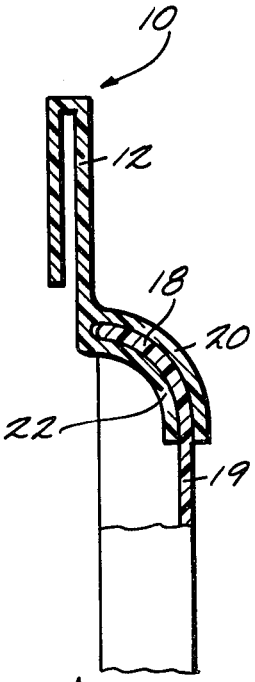
FIG. 2 is a sectional view of the apparatus shown in FIG. 1.

Referring more particularly to the drawing, wherein like parts are labelled with the same numbers, and modified parts are labelled with the same numbers and subscript letters a or b, FIGS. 1 and 2 show an apparatus which embodies the invention and comprises a clip 10 with a first means, preferably a U-shaped portion 12, for securing the clip 10 to the wearer's garment or belt 14, and a second means 16 for securing the curved outer edge portion 18 of a flying disc 19 to the clip 10. The second means for securing the edge of the disc is comprised of two curved arms 20 and 22 which generally conform to the curved outer edge 18 of the flying disc, but are spaced apart so the outer edge of the disc can be placed between the arms.

The person wearing the clip 10 inserts the flying disc between the two curved arms 20 and 22, which curved arms preferably are flexible and will spread apart, assisting movement of the edge of the disc into the space between the arms. This procedure is performed prior to securing the U-shaped portion 12 to the wearers garment, to insure clearance while inserting the disc. After the disc is in place, the arms will hold the disc in place in a generally verticle plane adjacent the wearer's garment. The disc is removed from the clip by reversing the above procedure.

The clip 10 is preferably integrally molded and may be made from plastic or some other flexible resilient material. Injection molding or some other desired method may be used for forming the particular shape of the clip.

Figure 3:
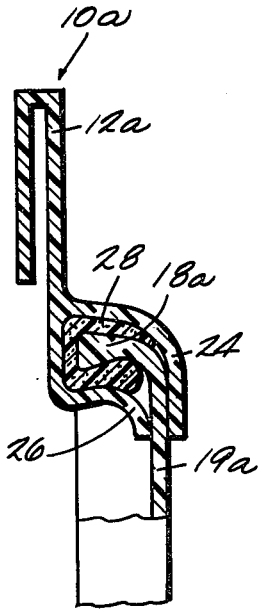
FIG. 3 is a sectional view of another embodiment of the invention.

FIG. 3 shows an alternate embodiment of the invention, clip **10*a*, having a pair of wider spaced apart curved arms 24 and 26 having a generally U-shaped flexible and resilient portion 28, such as foam rubber, suitably secured between said arms. The resilient portion 28 deforms or opens when the outer edge 18*a* of a disc is inserted into it, and then closes around the edge of the disc so the disc is retained by the resilient portion between the spaced apart arms 24 and 26. This arrangement allows for use of the clip 10*a* with flying discs having different outer edge configurations, as shown. When the edge of the disc is removed from the clip 10*a*, the resilient portion 28** will open and then return to its normal shape.

Figure 4:
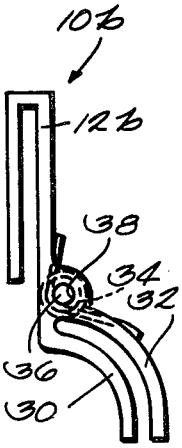
FIG. 4 is an end view of another embodiment of the invention.
Figure 5:
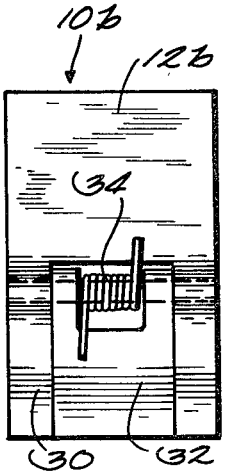
FIG. 5 is a side view of the apparatus shown in FIG. 4.

FIGS. 4 and 5 show an alternate embodiment of the invention, clip **10*b*. The second means for securing the outer edge portion of the flying disc includes a first arm portion 30 generally conforming to the curved outer edge portion 18 of the flying disc 19, and a second curved arm portion 32 generally conforming to the curved outer edge portion 18 of the flying disc. Preferably, one of the curved arms is movably connected to the U-shaped portion 12*b*** and the second means further comprises bias means for biasing the one movably connected arm toward the other curved arm, for allowing the curved arms to receive, retain and release the curved outer edge portion of the flying disc.

In the preferred illustrated construction shown the second arm portion 32 is rotatably attached to the U-shaped portion **12*b*, with bias means or a spring 34 connected to both arm portions 30 and 32 to cause the arms to be generally biased against each other but to be capable of allowing the flying disc to be inserted, retained, and removed from between the arms. The spring 34 is placed on a rod 36 which extends through a bore 38 going through both the U-shaped portion 12*b* of the clip 10*b* and the second arm portion 32. The spring 34 is placed on the rod 36 when the rod and second arm portion are assembled. The second arm portion 32 then turns on the rod 36 and is biased toward arm 30**.

It is to be understood that the invention is not confined to the particular construction as herein illustrated and described, but embraces all such modified forms thereof as come within the scope of the following claims.

I claim:

1. An apparatus for holding a flying disc having a curved outer edge portion, said apparatus comprising a clip including means for securing the clip to a wearer's garment, and spaced-apart curved arms connected to said securing means and extending generally downward therefrom, said arms generally conforming to the curved outer edge portion of the flying disc so that the outer edge of the flying disc can be inserted and removably held between said arms so that the flying disc hangs downward in a generally vertical plane adjacent to the wearer's garment.

2. An apparatus in accordance with claim 1 wherein said securing means comprises a generally U-shaped portion.

3. An apparatus in accordance with claim 2 wherein at least one of said curved arms is flexible so that said arms can be spread apart, assisting movement of the edge of the flying disc into a position between the spaced-apart curved arms.

4. An apparatus in accordance with claim 2 and further including a generally U-shaped flexible and resilient portion secured between said spaced-apart curved arms, said resilient portion being operative to receive, retain and release the curved outer edge portion of the flying disc.

5. An apparatus in accordance with claim 2 wherein one of said curved arms is movably connected to said U-shaped portion and further comprising bias means for biasing said movably connected arm toward said other curved arm, for allowing said curved arms to receive, retain and release the curved outer edge portion of the flying disc.

6. An apparatus in accordance with claim 2 wherein said clip, including said securing means and said curved arms, comprises a one-piece integrally molded member.

* * * * *